US006672790B2

(12) United States Patent
Davis

(10) Patent No.: US 6,672,790 B2
(45) Date of Patent: Jan. 6, 2004

(54) SPLICED ELONGATE MEMBER AND METHOD

(76) Inventor: George W. Davis, 10632 John Price Rd., Charlotte, NC (US) 28273

( * ) Notice: Subject to any disclaimer, the term of this patent is extended or adjusted under 35 U.S.C. 154(b) by 5 days.

(21) Appl. No.: 10/087,336

(22) Filed: Mar. 1, 2002

(65) Prior Publication Data

US 2003/0164055 A1 Sep. 4, 2003

(51) Int. Cl.[7] ..... F16B 11/00
(52) U.S. Cl. ..... 403/267; 139/449
(58) Field of Search ..... 403/265, 266, 403/267, 268; 74/422; 29/525.01; 139/449; 474/253

(56) References Cited

U.S. PATENT DOCUMENTS 3,901,285 A * 8/1975 Griffith ..... 139/449
4,690,177 A * 9/1987 Gehring et al. ..... 139/449
5,135,033 A * 8/1992 Stacher et al. ..... 139/449
5,318,077 A * 6/1994 Yamashita ..... 139/449
5,950,686 A * 9/1999 Herrlein et al. ..... 139/449

* cited by examiner

*Primary Examiner*—David A. Bucci
*Assistant Examiner*—Bradley J. VanPelt
(74) *Attorney, Agent, or Firm*—Adams Evans P.A.

(57) ABSTRACT

The invention discloses an elongate spliced member, particularly a tooth rack for a rapier loom, and a method for making same. The spliced member includes two elongate member segments joined at respective ends and having at least one through aperture positioned laterally from a respective first side to a second side adjacent the joined ends. An elongate recess is formed on opposed surfaces of the member segments, and each recess surrounds a respective aperture and communicates with the respective joined end of the segments. A carbon fiber strand is wound alternately through the aperture in each of the segments to splice the segments together end-to-end. The spliced member has the functional characteristics equivalent to an integrally formed member of the same length.

19 Claims, 8 Drawing Sheets

Fig. 4
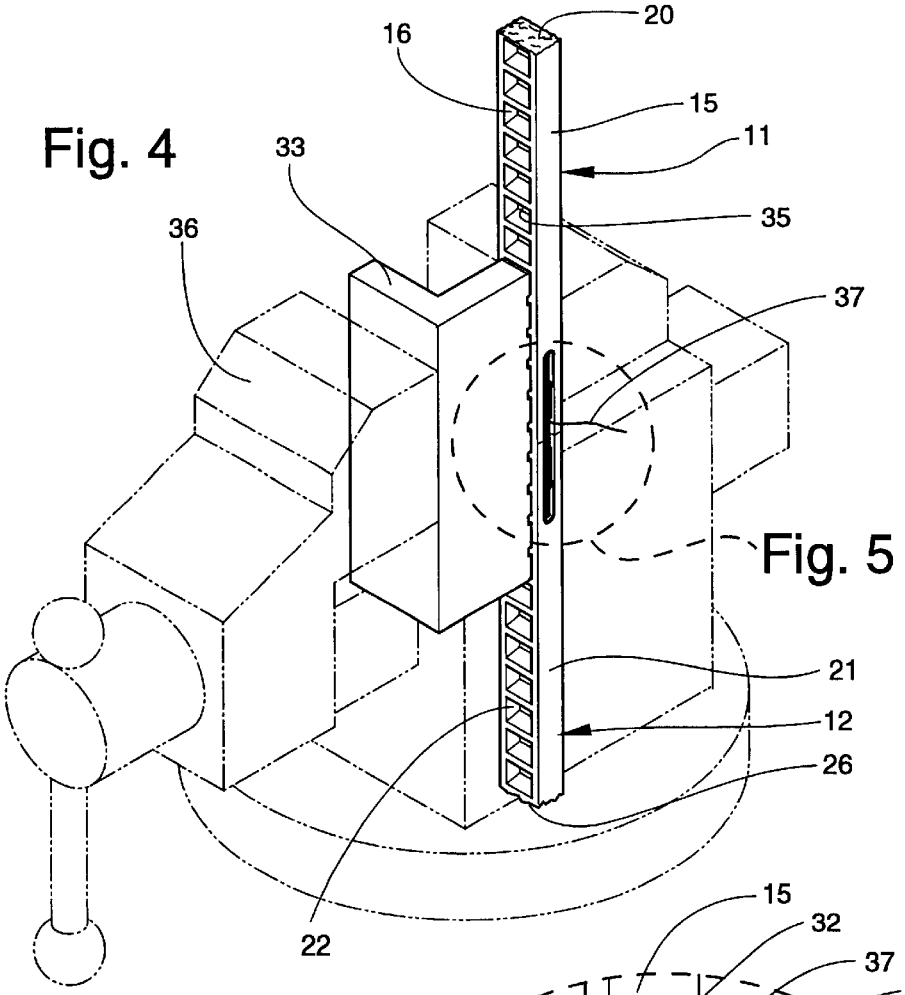
Fig. 5
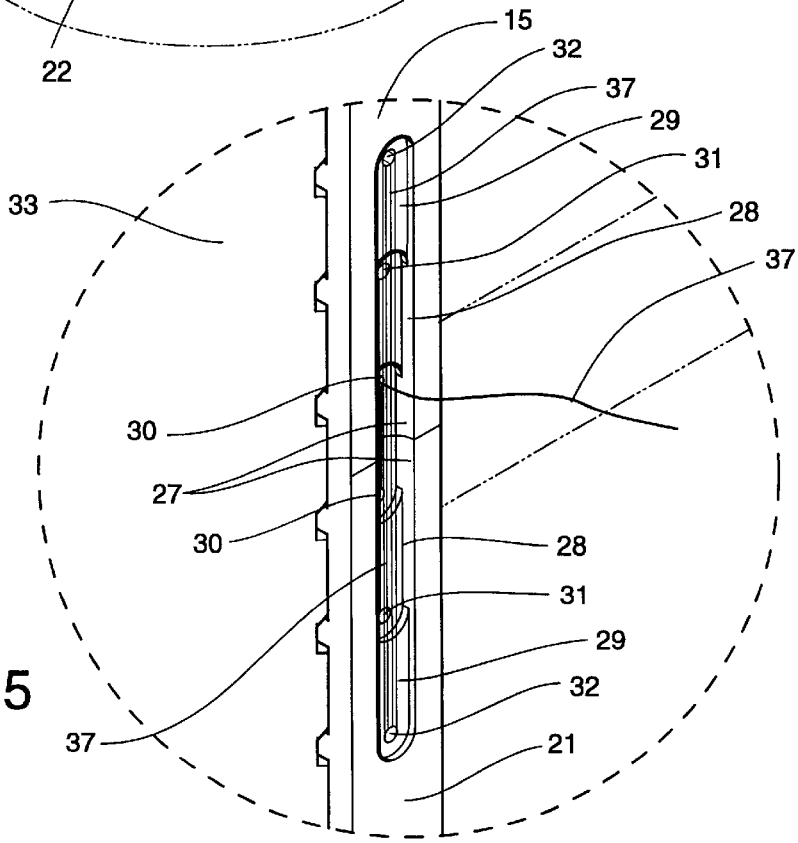
Fig. 5

SPLICED ELONGATE MEMBER AND METHOD

TECHNICAL FIELD AND BACKGROUND OF THE INVENTION

The invention relates to a method for uniting two relatively short segments to form a single elongate member having functional characteristics equivalent to an integrally-formed member of the same length. The segments are spliced with a fibrous strand, which is then covered with an adhesive. While the invention has applications in a variety of fields, it is particularly useful with regard to elongate tooth racks used on a rapier loom.

In the field of textiles, a tooth rack is a commonly replaced portion of a rapier loom. The tooth rack facilitates movement of the rapier from opposite sides of the loom. The tooth rack is subject to considerable wear and tear and often breaks into two parts, requiring either repair of the broken tooth rack or replacement with a new one. Frequent replacement of the tooth rack is costly and can result in production delays if a new tooth rack is not readily available. Repairing the tooth rack by attempting to rejoin the broken pieces by conventional means is problematic in that it often yields an unsatisfactory tooth rack that lacks the strength and other desirable characteristics of the original. In an effort to overcome and eliminate the aforementioned problems, the present invention was conceived.

SUMMARY OF THE INVENTION

Therefore it is an object of the present invention to provide a method for uniting two segmented objects into a single elongated member having the strength, flexibility and other functional characteristics equivalent to an integrally-formed member of the same length.

It is another object of the invention to provide a method for repairing,broken tooth racks so that they are acceptable for re-use on a rapier loom.

It is yet another object of the invention to provide a spliced elongate member formed from splicing together two shorter segmented members.

These and other objectives of the present invention are achieved by providing an elongate spliced member comprising first and second elongate member segments of predetermined length positioned and joined at respective ends to define the spliced member having a length which is the sum of the predetermined lengths of the first and second elongate members. At least one through aperture is positioned in each of the first and second elongate member segments laterally from a respective first side to a second side adjacent the joined ends. An elongate recess is formed on opposed surfaces of each of the first and second elongate member segments, and each recess surrounds a respective aperture and communicates with the respective joined end of the first and second elongate member segments. A carbon fiber strand is wound alternately through the aperture in each of the first and second elongate member segments for binding the first and second elongate member segments together end-to-end. The spliced member has functional characteristics equivalent to an integrally-formed member of the same length.

According to one preferred embodiment of the invention, the first and second elongate member segments mate together at respective ends to form intimate contact with each other.

According to another preferred embodiment of the invention, the apertures are defined by rounded edges in the first and second elongate member segments to reduce stress on the carbon fiber strand by reducing sharp bending thereof.

According to yet another preferred embodiment of the invention, the carbon fiber strand is wound along the recesses such that the carbon strand is flush with adjacent surfaces of the first and second elongate member segments.

According to yet another preferred embodiment of the invention, an elongate spliced member includes an adhesive covering the carbon strand and occupying voids defined by the carbon strand and the recesses in the first and second elongate member segments.

According to yet another preferred embodiment of the invention, the adhesive is an epoxy.

According to yet another preferred embodiment of the invention, the elongate spliced member includes a series of elongate recesses of varying depth formed on opposed surfaces of each of the first and second elongate member segments. Each recess surrounds a respective aperture and communicates with the respective joined end of the first and second elongate member segments.

According to yet another preferred embodiment of the invention, the elongate recesses are located proximate an end of the first and second elongate member segments. The recesses decrease in depth from the recesses located nearest to the ends having the greatest depth to the recesses located furthest from the ends having the least depth.

According to yet another preferred embodiment of the invention, the carbon fiber strand is wound around the recesses having greater depth a greater number of times than around the recesses having less depth.

According to yet another preferred embodiment of the invention, the first and second elongate member segments include a longitudinal surface having teeth.

According to yet another preferred embodiment of the invention, the elongate spliced member is a tooth rack for a rapier loom.

According to yet another preferred embodiment of the invention, an elongate spliced member comprises first and second elongate member segments of predetermined length positioned and joined at respective ends to define the spliced member having a length which is the sum of the predetermined lengths of the first and second elongate members. At least three through apertures are positioned in each of the first and second elongate member segments laterally from a respective first side to a second side adjacent the joined ends. First, second and third adjacent and communicating elongate recesses are formed on opposed surfaces of each of the first and second elongate member segments proximate the joined ends of the first and second elongate member segments. The first recess communicates with the respective joined end and has a predetermined depth greater than the second and third recesses. The second recess has a depth greater than the third recess, and the third recess has a predetermined depth less than the first and second recesses. Each recess surrounds a respective aperture. A carbon fiber strand is wound alternately through the apertures in each of the first and second elongate member segments to bind the first and second elongate member segments together end-to-end. The spliced member has functional characteristics equivalent to an integrally-formed member of the same length.

According to yet another preferred embodiment of the invention, the carbon fiber strand is wound through the apertures four times.

According to yet another preferred embodiment of the invention, the carbon fiber strand is wound along the first, second and third elongate recesses such that the carbon fiber strand is flush with the surfaces of the first and second elongate member segments.

An embodiment of the method of uniting two elongate member segments to form a single elongate member according to the invention includes the step of providing first and second elongate member segments of predetermined length, each having first and second opposite ends.

In addition, at least one through aperture is formed within each of the first and second elongate member segments laterally from a respective first side to a second side adjacent one end thereof. An elongate recess of predetermined depth is formed on opposed surfaces of each of the first and second elongate member segments communicating with the first end of the first and second elongate member segments, with each recess surrounding a respective aperture. The first and second elongate member segments are positioned such that the first end of the first elongate member segment is adjacent to the first end of the second elongate member segment. Finally, a carbon fiber strand is alternately wound through the apertures of the first and second elongate member segments to bind the first and second elongate member segments together end-to-end to form a single elongate member.

Another embodiment of the method of uniting two elongate member segments to form a single elongate member according to the invention includes the step of repeatedly winding the carbon fiber strand through the apertures of the first and second elongate member segments until the carbon fiber strand substantially occupies the recess.

Yet another embodiment of the method of uniting two elongate member segments to form a single elongate member according to the invention includes the step of heating one end of the carbon fiber strand to harden the end thereby facilitating insertion of the carbon fiber strand into the apertures.

Yet another embodiment of the method of uniting two elongate member segments to form a single elongate member according to the invention includes the step of covering the carbon fiber strand with an adhesive.

Yet another embodiment of the method of uniting two elongate member segments to form a single elongate member according to the invention includes the step of covering the carbon fiber strand with an epoxy resin and filling voids defined by the carbon fiber strand and the elongate recesses with the epoxy resin.

Yet another embodiment of the method of uniting two elongate member segments to form a single elongate member according to the invention includes the step of heating the epoxy resin at 300 degrees Fahrenheit for approximately thirty minutes.

Yet another embodiment of the method of uniting two elongate member segments to form a single elongate member according to the invention includes the step of providing first and second elongate member segments of predetermined length, each having first and second opposite ends, and forming at least three through aperture within each of the first and second elongate member segments laterally from a respective first side to a second side. In addition, first, second and third adjacent and communicating elongate recesses are formed on opposed surfaces of each of the first and second elongate member segments, the first recess communicating with the first end of the elongate member segments and having a predetermined depth greater than the second and third recesses. The second recess has a predetermined depth greater than the third recess, and the third recess has a predetermined depth less than the first and second recesses. Each recess surrounds a respective aperture. First and second elongate member segments are positioned such that the first end of the first elongate member segment is adjacent to the first end of the second elongate member segment. Finally, a carbon fiber strand is alternately wound through the apertures of the first and second elongate member segments to bind the first and second elongate member segments together end-to-end to form a single elongate member.

Yet another embodiment of the method of uniting two elongate member segments to form a single elongate member according to the invention includes the step of forming the first recess to have a depth of approximately 0.074 inches, forming the second recess to have a depth of approximately 0.052 inches, and forming the third recess to have a depth of approximately 0.030 inches.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 4 is a perspective view of the preferred member segments being spliced together with a carbon fiber strand;

FIG. 5 is an enlarged perspective view of the preferred member segments being spliced together with a carbon fiber strand;

DESCRIPTION OF THE PREFERRED EMBODIMENT AND BEST MODE

Figure 6:
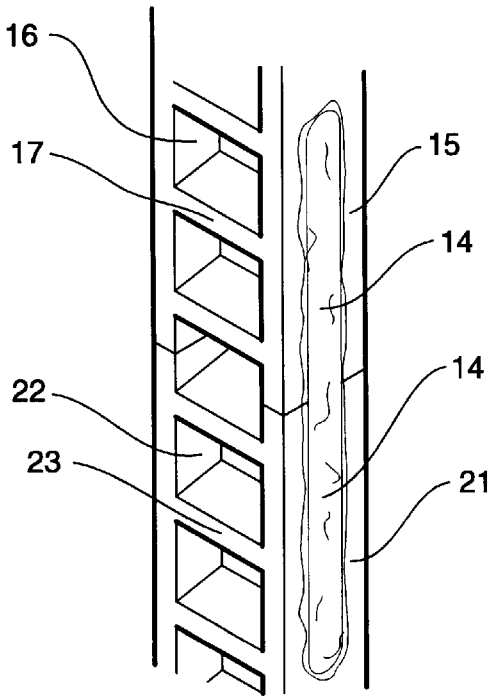
FIG. 6 is a partial perspective view of the preferred member segments spliced together as a single elongate member and covered with an epoxy adhesive.
Figure 7:
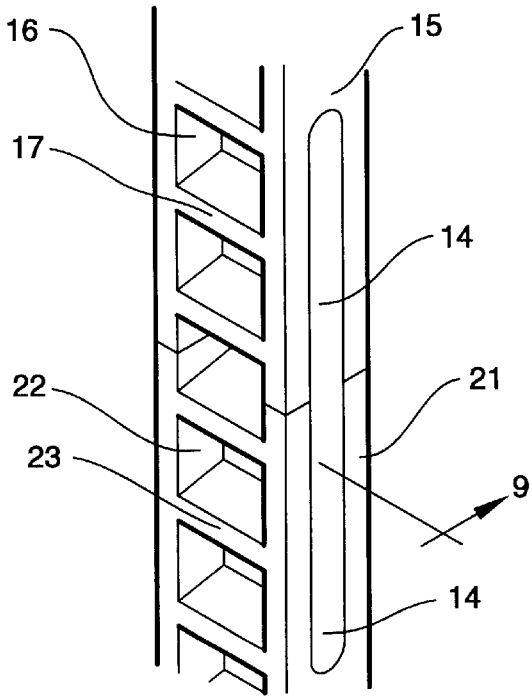
FIG. 7 is a partial perspective view of the spliced elongate member of FIG. 6 after the epoxy has been heated and cured.
Figures 10, 11, 12:
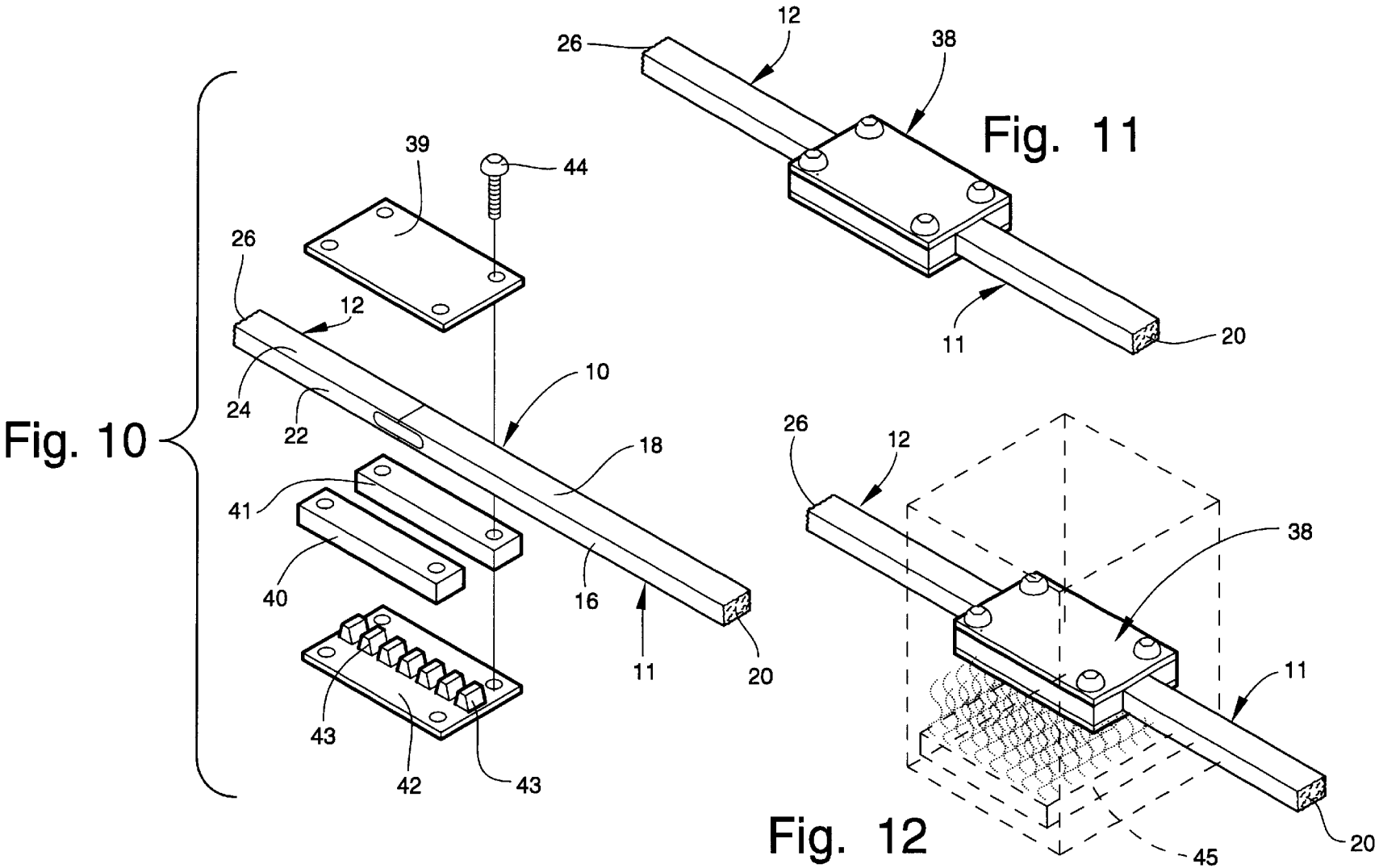
FIG. 10 is a perspective view of a preferred spliced elongate member and exploded parts of a holding unit.
FIG. 11 is a perspective view of a preferred elongate spliced member contained in the holding unit of FIG. 10.
FIG. 12 is a perspective view of the preferred spliced elongate member and holding unit of FIG. 11 in a heating unit (shown in phantom)
Figure 13:
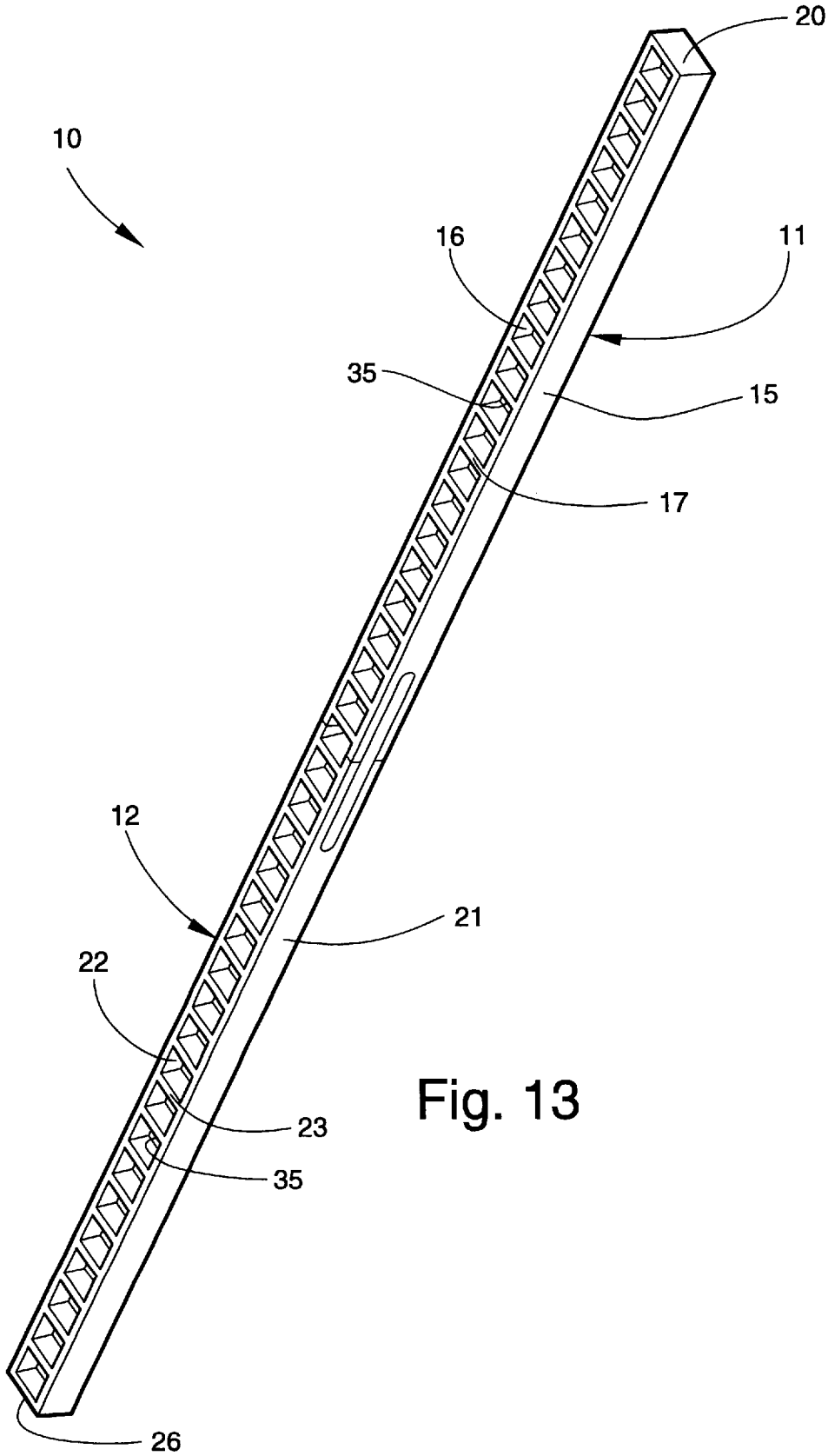
FIG. 13 is a perspective view of a preferred spliced elongate member.

Referring now specifically to the drawings, a preferred embodiment of the spliced elongate member according to the present invention is illustrated in FIG. 13, and shown generally at reference numeral 10. The preferred spliced member comprises two elongate member segments 11 and 12 spliced together with a carbon fiber strand 37, as shown in FIGS. 4 and 5, covered with an adhesive 14, as shown in FIG. 6, that is heated and cured, as shown in FIG. 12. For purposes of this description of the preferred embodiment and best mode, the preferred elongate member 10 is a tooth rack comprising tooth rack segments 11, 12.

Figure 1:
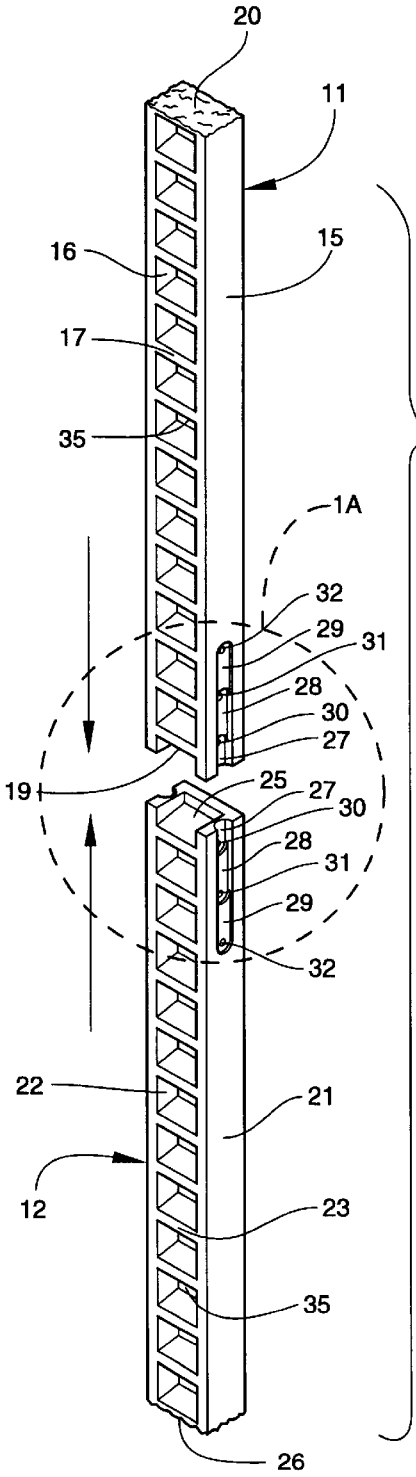
FIG. 1 is a perspective view of two preferred member segments of the invention prior to being spliced into a single elongate member.

As can be seen in FIG. 1, the preferred tooth rack segments 11, 12 are rectangular in shape and are identical in all respects. Tooth rack segment 11 comprises side surfaces 15, 16, front surface 17, rear surface 18, and opposing ends 19, 20. Likewise, tooth rack segment 12 comprises side surfaces 21, 22, front surface 23, rear surface 24, and opposing ends 25, 26.

Figure 1A:
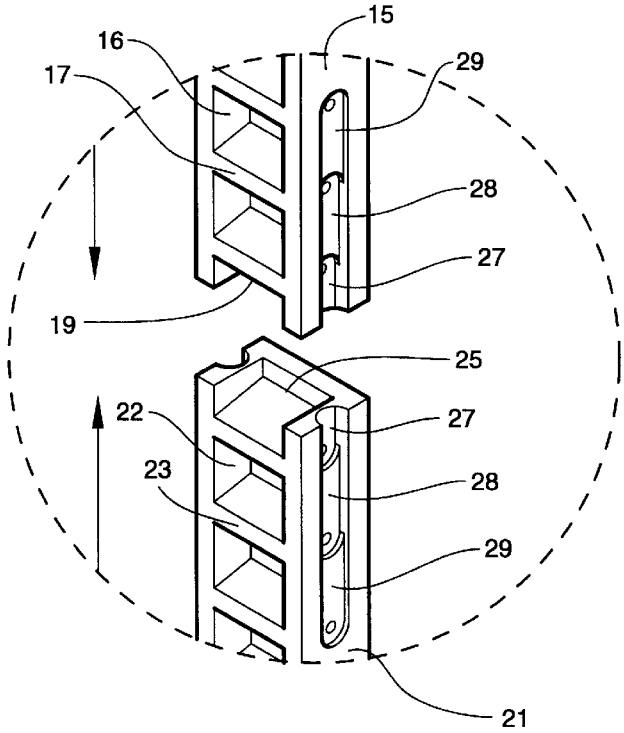
FIG. 1A is an enlarged perspective view of the preferred member segments of FIG. 1.
Figure 8:
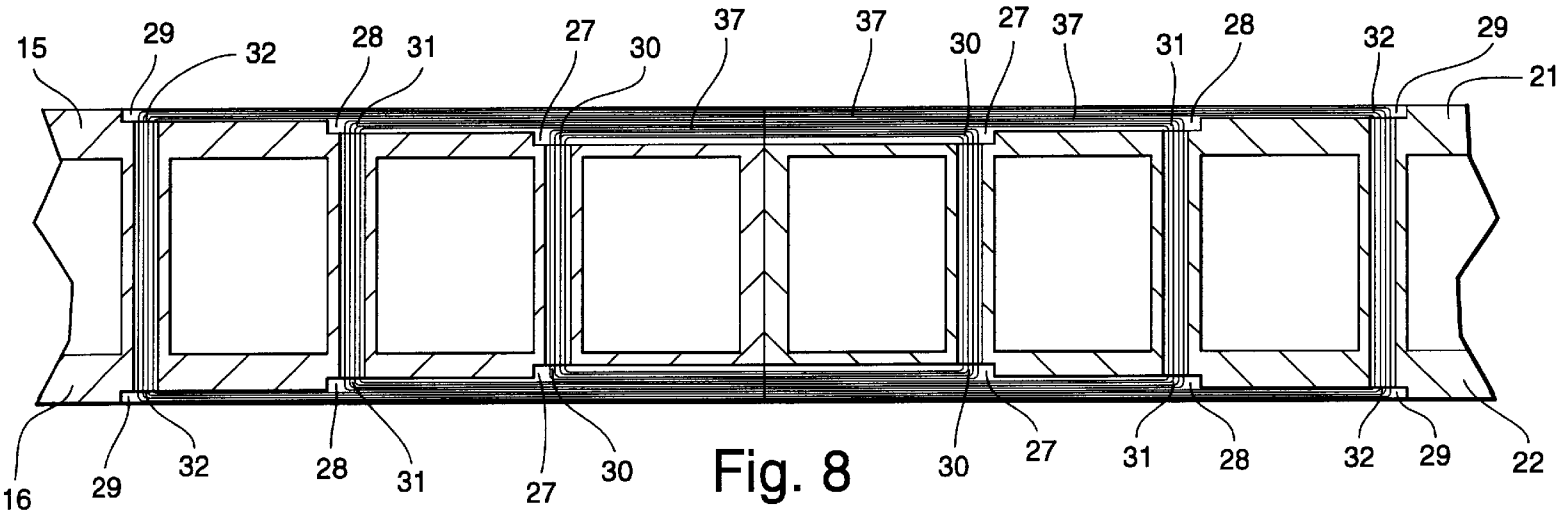
FIG. 8 is a partial cross-sectional view of the preferred member segments spliced together with a carbon strand.

A series of three elongate recesses 27, 28, 29 of varying depth are formed in each of the side surfaces 15, 16, 21, 22, as shown in FIGS. 1A and 8. The recesses 27, 28, 29 reside adjacent to each other and communicate with each other. The first recess 27 begins at the ends 19, 25 of the tooth rack segments 11, 12 and has a depth greater than the other recesses 28, 29. The second recess 28 communicates with the first recess 27, and has slightly less depth than the first recess 27, but greater than the third recess 29. The third recess communicates with the second recess 28 and has the least depth. According to one embodiment of the invention, the first recess has a depth of approximately 0.074 inch, the second recess has a depth of approximately 0.052 inch, and the third recess has a depth of approximately 0.030 inch. Depending on the dimensions of the tooth rack segments 11, 12, any other depth that is predetermined to accept an adequate number of carbon fiber strands 37 can be used.

Each tooth rack segment 11, 12 has three apertures 30, 31, 32 extending laterally from one side surface 15, 21 through to the other side surface 16, 22, respectively. The first aperture 30 is positioned within the first recess 27. The second aperture 31 is positioned within the second recess 28, and the third aperture 32 is located within the third recess 29. The apertures 30, 31, 32 preferably have a diameter of approximately 0.1 inch.

Figure 3:
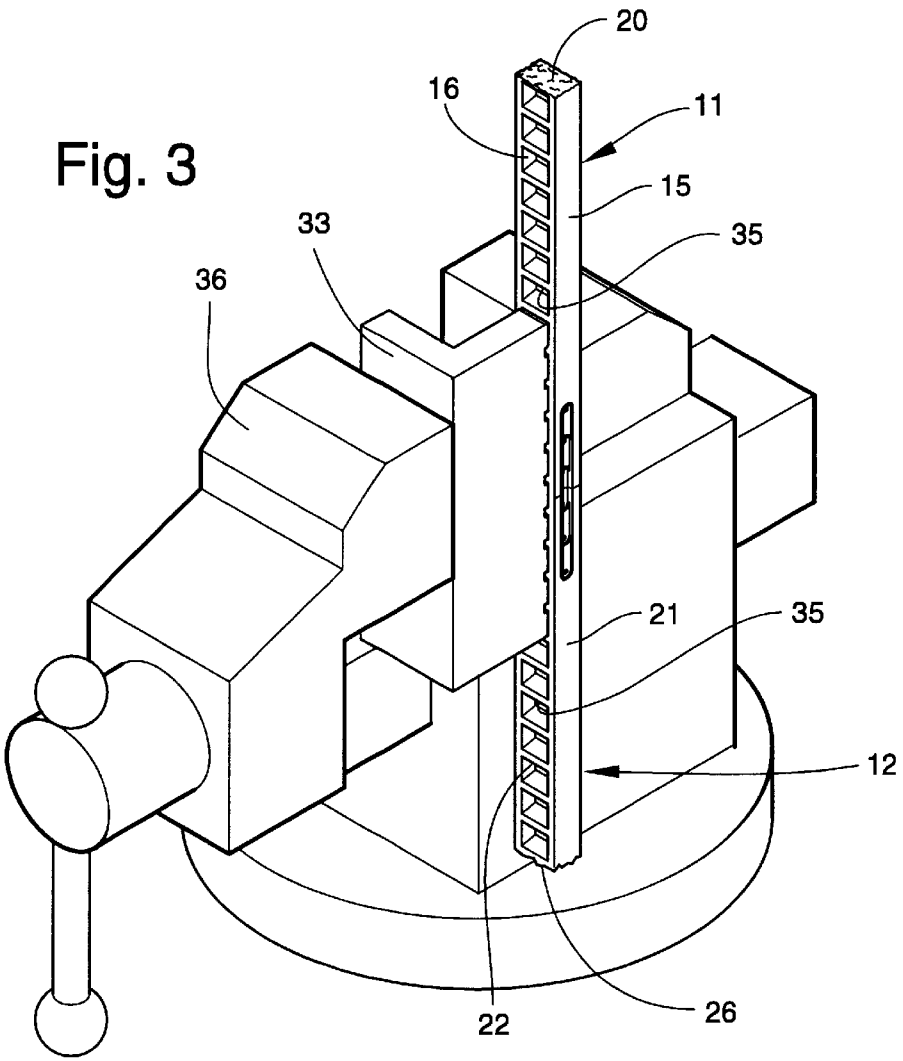
FIG. 3 is a perspective view of the preferred member segments on the stabilizing unit and held stationary by a vice grip.
Figure 2:
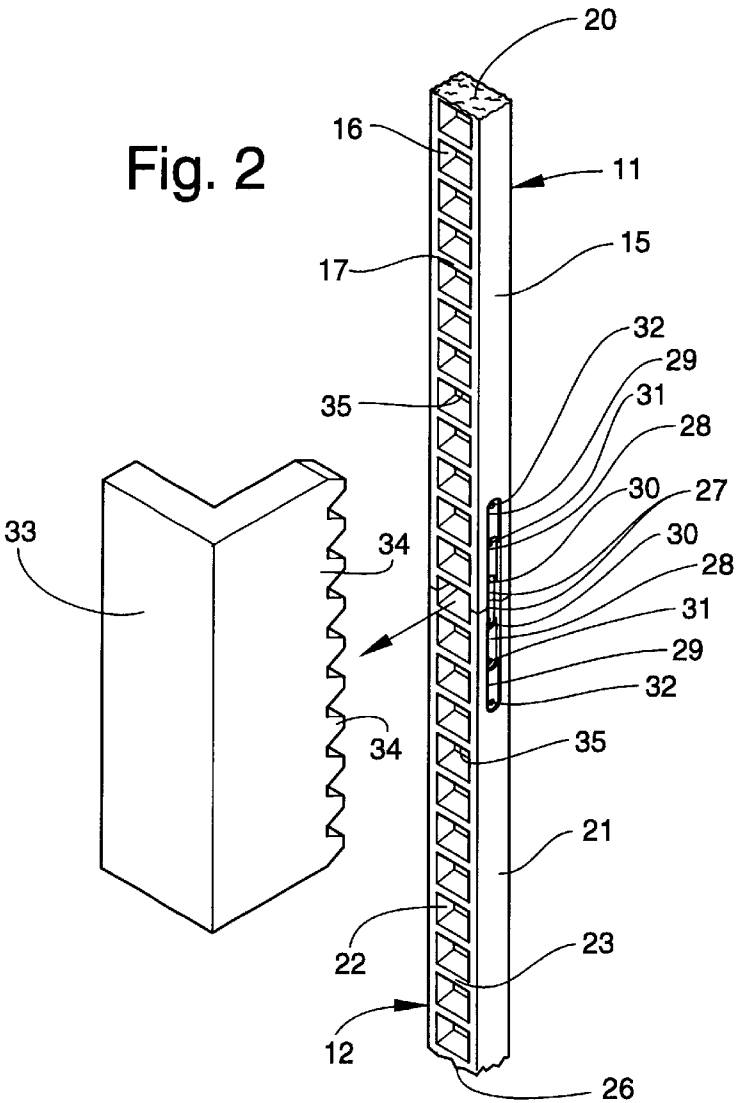
FIG. 2 is a perspective view of the preferred member segments being positioned on a stabilizing unit.

To splice the tooth rack segments 11, 12 into a single elongate tooth rack 10, the segments 11, 12 are positioned together so that ends 19 and 25 are adjacent to each other, as shown in FIG. 2. The ends 19, 25 of the segments 11, 12 are formed such that they can be mated together. In addition, the segments 11, 12 are positioned so that the front surfaces 17, 23 face a stabilizing unit 33, shown in FIG. 2. The front surfaces 17, 23 comprise a series of uniformly spaced apart teeth that define a series of rectangular slots 35. The stabilizing unit 33 has a plurality of corresponding teeth 34 that can fit within the rectangular slots 35 defined by the front surfaces 17, 23 of the segment members 11,12. The segments 11, 12 are moved onto the stabilizing unit 33, with the teeth 34 positioned within the slots 35 to hold the segments 11, 12 together in the desired position. The stabilizing unit 33 holds the segments 11, 12 together rigidly, with the ends 19 and 25 of segments 11, 12 coming into intimate contact with each other. The segments 11, 12 and the stabilizing unit are then held stationary in a vice grip 36, as shown in FIG. 3.

Figure 9:
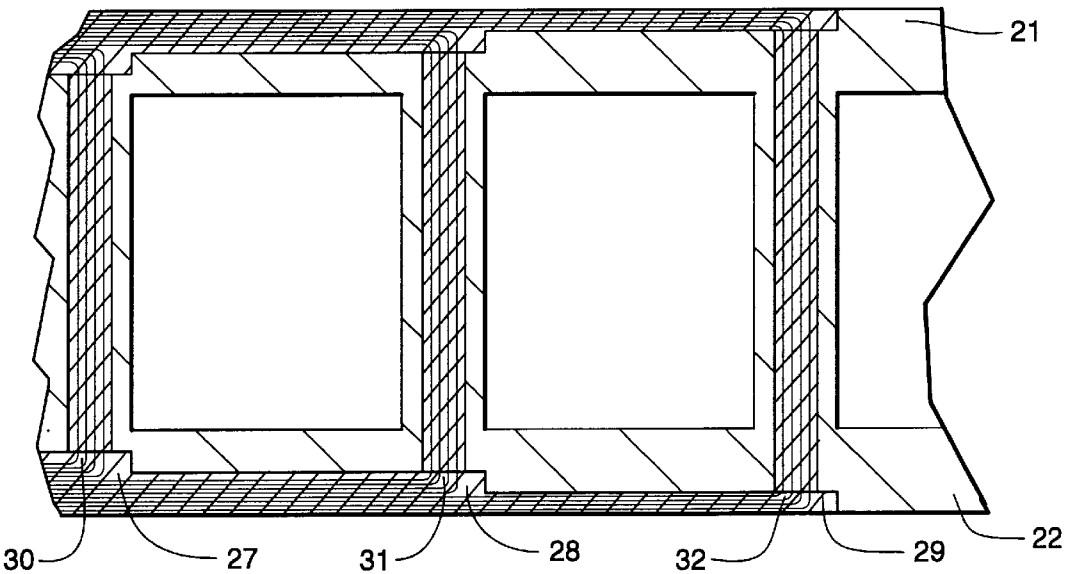
FIG. 9 is a partial cross-sectional view as along line 9 in FIG. 7.

A carbon strand 37, comprised of a plurality of carbon fibers, is alternately wound through the apertures 30, 31, 32 in each segment 11, 12 to splice the segments 11, 12 together as shown in FIGS. 4 and 5. The fibers of the carbon strand 37 do not elongate thereby maintaining tight contact between the ends 19, 25 of the segments 11, 12. One end of the carbon strand 37 is heated to form a needle-like end portion to facilitate its insertion into the apertures 30, 31, 32. The carbon strand 37 is wound through the apertures 30, 31, 32 until it substantially occupies the recesses 27, 28, 29 such that only small spaces remain between the strand 37 and the recesses 27, 28, 29. As such, the strand 37 appears to be flush with the non-recessed portion of the side surfaces 15, 16, 21, 22, as shown in FIG. 8. Preferably, the strand 37 is first wound four times through the first aperture 30 in segment 11 and the first aperture 30 in segment 12. The strand 37 is then wound four times through the second aperture 31 in segment 11 and the second aperture 31 in segment 12. Finally, the strand 37 is wound four times through the third aperture 32 in segment 11 and the third aperture 32 in segment 12. This results in there being a total of twelve lengths of strand 37 extending along the first recesses 27, eight lengths of strand 37 extending along the second recesses 28, and four lengths of strand 37 extending along the third recesses 29, as shown in FIGS. 8 and 9. Preferably, the apertures 30, 31, 32 are radiused reduce stress on the strand 37 by reducing sharp bending of the strand 37.

The recesses 30, 31, 32, and the carbon strand 37 are then covered with an adhesive 14, preferably an epoxy resin, as shown in FIGS. 6 and 9. The carbon strand 37 is preferably preimpregnated with epoxy resin. A preferred carbon strand 37 would be WDE Roving Prepeg manufactured by Newport Adhesives and Composites, Inc. The adhesive 14 covers the strand 37 and fills in the small spaces between the strand 37 and the recesses 30, 31, 32. The spliced segments 11, 12 are then placed in a clamp 38, shown in FIGS. 10 and 11. The clamp 38 comprises a top plate 39, left side member 40, right side member 41, and a base plate 42 having a series of teeth 43 linearly positioned on the center of the base plate 42 and protruding upward, as shown in FIG. 10. The spliced segments 11, 12 are positioned in the clamp 38 by inserting the teeth 43 of the base plate 42 into the rectangular slots 35. The left side member 40 and the right side member 41 are positioned onto the base plate 42, preventing lateral movement of the segments 11, 12. The top plate 39 is placed on top of the left side member 40 and right side member 41, and the unit 38 is affixed together with screws 44 extending from the top plate 39 to the base plate 42, as shown in FIG. 10. The clamp 38 keeps the spliced segments 11, 12 held securely together, as shown in FIG. 11. Finally, the spliced segments 11, 12 and the clamp 38 are placed into an oven 45, as shown in FIG. 12. Preferably, the epoxy resin 14 is heated at 300 degrees Fahrenheit for approximately thirty minutes. After the epoxy resin 14 has cooled, a preferred elongate tooth rack 10 is produced, as shown in FIG. 13.

Figure 14A:
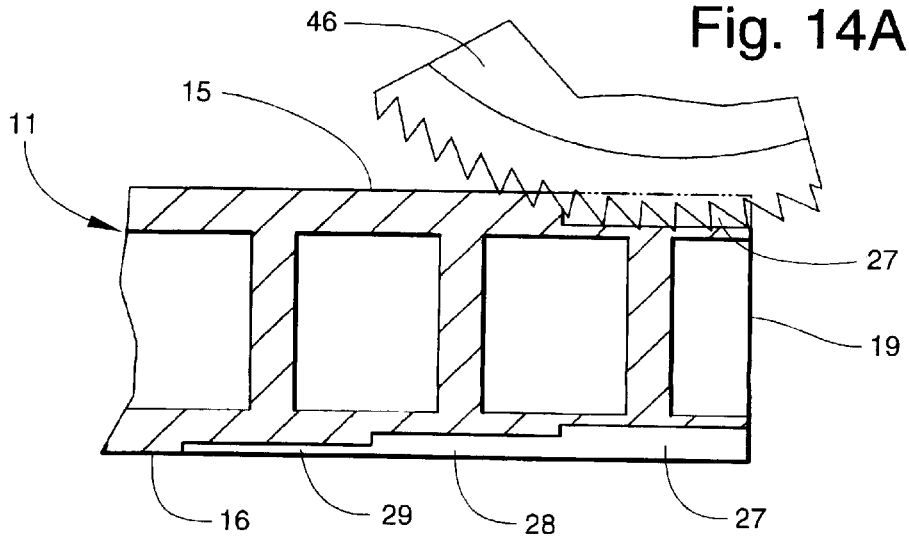
FIG. 14A is a partial perspective view of a recess being formed on a preferred member segment.
Figure 14B:
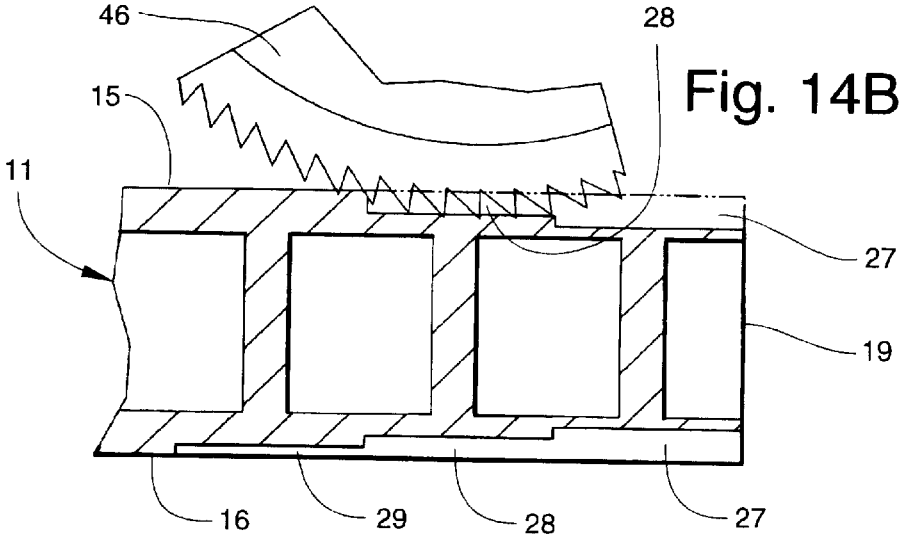
FIG. 14B is a partial perspective view of a second recess being formed on the member segment of FIG. 14A.
Figure 14C:
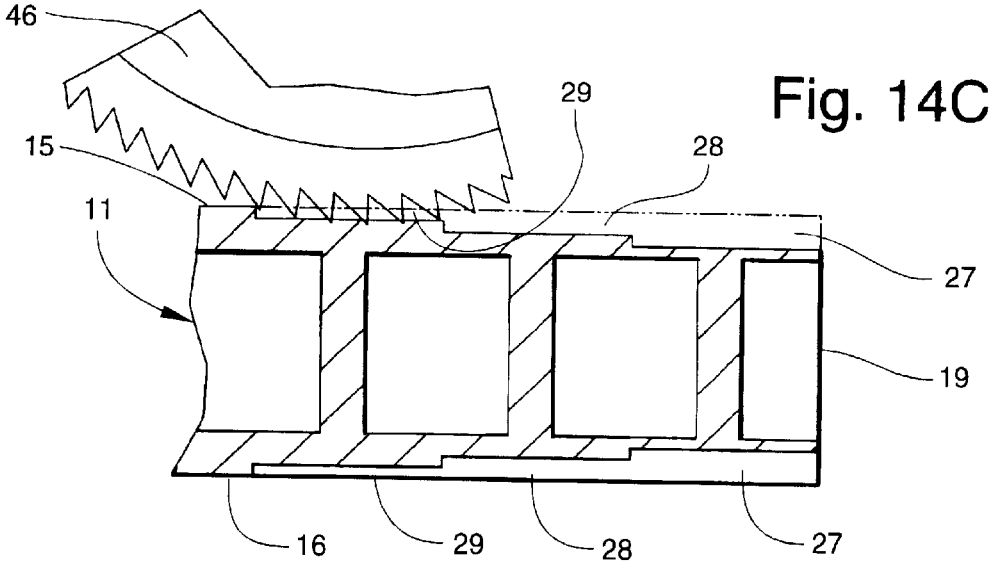
FIG. 14C is a partial perspective view of a third recess being formed on the member segment of FIG. 14A.

A preferred method for forming the recesses 27, 28, 29 in the side surfaces 15, 16, 21, 22 of tooth rack segments 11, 12 is illustrated in FIGS. 14A, 14B, and 14C. As shown in FIG. 14A, a cylindrical cutting blade 46, preferably having a diameter of ¾ of an inch, turns in a circular motion and cuts into a side surface 15 of tooth rack segment 11 at end 19 to form the first and deepest recess 27. The cutting blade 46 preferably is held stationary while the tooth rack segment 11 is moved in position so that cutting blade 46 forms the second recess 28, as shown in FIG. 14B. The tooth rack segment 11 is then moved once again so that cutting blade 46 forms the third recess 29, as shown in FIG. 14C. The same process is used to form recesses 27, 28, 29 in the other side surface 16 of tooth rack segment 11, and side surfaces 21, 22 of tooth rack segment 12.

The above description of the preferred embodiment and best mode of the invention specifically describes a single elongate tooth rack for a rapier loom and a method for making the tooth rack with two relatively small tooth rack segments. However, the invention can be used in a variety of fields and encompasses a method for uniting various segmented objects into a single elongate member having the same characteristics as the segmented objects prior to being united.

A spliced elongate member and a method for making same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An elongate spliced member comprising:

(a) first and second elongate member segments of predetermined length positioned and joined at respective ends to define the spliced member having a length which is the sum of the predetermined lengths of the first and second elongate members;

(b) at least one through aperture positioned in each of the first and second elongate member segments laterally from a respective first side to a second side adjacent the joined ends;

(c) an elongate recess formed on opposed surfaces of each of the first and second elongate member segments, each said recess surrounding a respective aperture and communicating with the respective joined end of the first and second elongate member segments; and (d) a carbon fiber strand wound alternately through said at least one aperture in each of the first and second elongate member segments for binding the first and second elongate member segments together end-to-end, the spliced member having functional characteristics equivalent to an integrally-formed member of the same length.

2. An elongate spliced member according to claim 1 wherein said first and second elongate member segments mate together at respective ends to form intimate contact with each other.

3. An elongate spliced member according to claim 1 wherein said apertures are defined by rounded edges in said first and second elongate member segments to reduce stress on said fiber carbon fiber strand by reducing sharp bending thereof.

4. An elongate spliced member according to claim 1 wherein said carbon fiber strand is wound along said recesses such that said carbon strand is flush with adjacent surfaces of said first and second elongate member segments.

5. An elongate spliced member according to claim 1 further comprising an adhesive covering said carbon strand and occupying voids defined by said carbon strand and said recesses in said first and second elongate member segments.

6. An elongate spliced member according to claim 5 wherein said adhesive is an epoxy.

7. An elongate spliced member according to claim 1 comprising a series of elongate recesses of varying depth formed on opposed surfaces of each of the first and second elongate member segments, each said recess surrounding a respective aperture and communicating with the respective joined end of the first and second elongate member segments.

8. An elongated spliced member according to claim 7 wherein said series of elongate recesses are located proximate an end of said first and second elongate member segments, said recesses decreasing in depth from the recesses located nearest to said ends having the greatest depth to the recesses located furthest from said ends having the least depth.

9. An elongate spliced member according to claim 7 wherein said carbon fiber strand is wound around the recesses having greater depth a greater number of times than around the recesses having less depth.

10. An elongate spliced member according to claim 1 wherein said first and second elongate member segments comprise a longitudinal surface having teeth.

11. An elongate spliced member according to claim 10 wherein said spliced tooth rack segment is a tooth rack for a rapier loom.

12. An elongate spliced member comprising:

(a) first and second elongate member segments of predetermined length positioned and joined at respective ends to define the spliced member having a length which is the sum of the predetermined lengths of the first and second elongate members;

(b) at least three through apertures positioned in each of the first and second elongate member segments laterally from a respective first side to a second side adjacent the joined ends;

(c) first, second and third adjacent and communicating elongate recesses formed on opposed surfaces of each of the first and second elongate member segments proximate the joined ends of said first and second elongate member segments, said first recess communicating with the respective joined end and having a predetermined depth greater than said second and third recesses, said second recess having a predetermined depth greater than said third recess, and said third recess having a predetermined depth less than said first and second recesses, each said recess surrounding a respective aperture; and (d) a carbon fiber strand wound alternately through said at least three apertures in each of the first and second elongate member segments for binding the first and second elongate member segments together end-to-end, the spliced member having functional characteristics equivalent to a integrally-formed member of the same length.

13. An elongate spliced member according to claim 12 wherein said carbon fiber strand is wound through each aperture four times.

14. An elongate spliced member according to claim 12 wherein said carbon fiber strand is wound along said first, second and third elongate recesses such that said carbon fiber strand is flush with said surfaces of said first and second elongate member segments.

15. An elongate spliced member according to claim 12 wherein said apertures are defined by rounded edges of said first and second elongate member segments to reduce stress on said carbon strand by reducing sharp bending of said carbon strand.

16. An elongate spliced member according to claim 12 wherein said elongate member segments comprise a longitudinal surface defining a series of uniformly spaced apart teeth.

17. An elongate spliced member according to claim 12 wherein said spliced member is a tooth rack for a rapier loom.

18. An elongate spliced member according to claim 12 further comprising an adhesive covering said carbon strand and occupying voids defined by said carbon strand and the recesses in said lateral surfaces.

19. An elongate spliced member according to claim 18 wherein said adhesive is an epoxy.

* * * * *